United States Patent [19]

Lam

[11] Patent Number: 4,945,523

[45] Date of Patent: Jul. 31, 1990

[54] TIMEPIECE GLASS ASSEMBLY AND A TIMEPIECE

[76] Inventor: Philip Y. Lam, Room 1107, Hang Shing Building, 363-373 Nathan Road, P.O. Box 96259, T.S.T., Kowloon, Hong Kong

[21] Appl. No.: 446,980

[22] Filed: Dec. 5, 1989

[30] Foreign Application Priority Data

Dec. 6, 1988 [GB] United Kingdom ..... 8828406

[51] Int. Cl.[5] ..... G04B 37/00

[52] U.S. Cl. ..... 368/285; 368/296

[58] Field of Search ..... 368/223–232, 368/276, 285, 294–296

[56] References Cited

U.S. PATENT DOCUMENTS 2,854,815 10/1958 Piquerez ..... 368/296
3,657,876 4/1972 Hancock, Jr. ..... 368/296
3,939,646 2/1976 Uchitama ..... 368/296

FOREIGN PATENT DOCUMENTS 299425 6/1954 Switzerland ..... 368/296
349544 10/1960 Switzerland ..... 368/296

*Primary Examiner*—Vit W. Miska
*Attorney, Agent, or Firm*—Kenyon & Kenyon

[57] ABSTRACT

A timepiece glass assembly (1) is provided having a pair of superimposed, spaced apart, transparent glasses (2, 3) held together round their peripheries by a holding ring (6) in a manner such as to define between the glasses and ring an internal chamber (4). The chamber (4) may contain a fluid such as scent or a medicament and movable objects or particles (5) for decorative effect. The fluid is allowed to escape to the exterior of the chamber (4) via a passage (8) through the holding ring (6) in a manner controlled by a semi-sealing ring (10) which closes off the outer end of the passage (8). The ring (10) absorbs fluid and allows the scent and/or medicament to vaporize therefrom and escape to the exterior of the assembly (1) which may be removably attached to any suitable timepiece such as a wrist watch.

9 Claims, 1 Drawing Sheet

FIG. 1
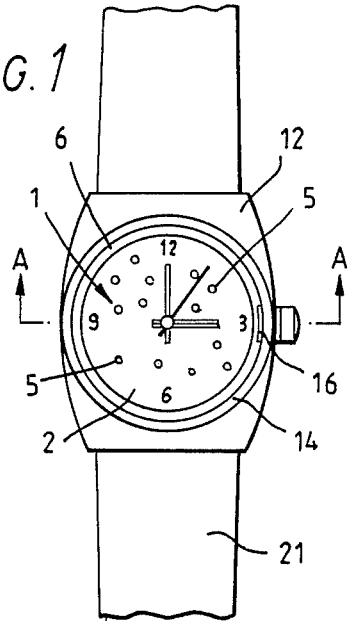
FIG. 2
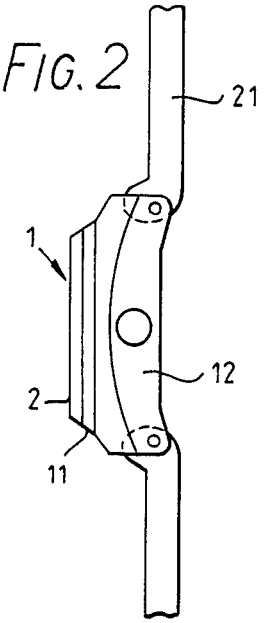
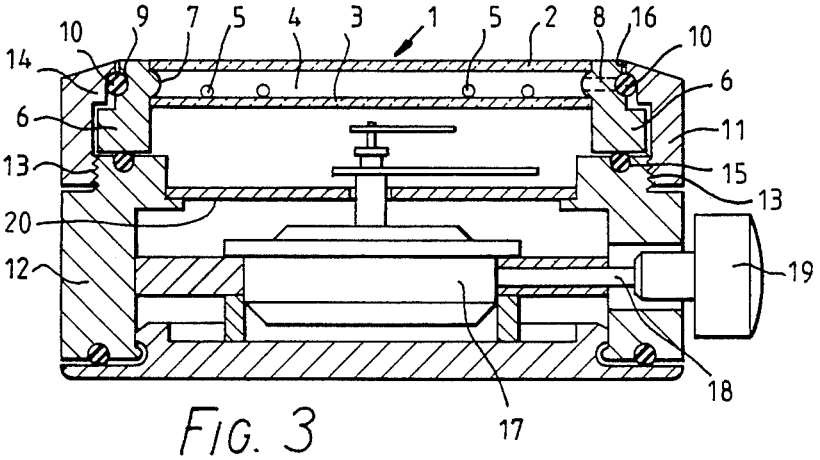
FIG. 3

TIMEPIECE GLASS ASSEMBLY AND A TIMEPIECE

This invention relates to a timepiece glass assembly and a timepiece.

According to the present invention there is provided a timepiece glass assembly having a pair of superimposed, spaced apart, transparent glasses, means for holding said glasses around their peripheries in said spaced apart disposition to define between and with said glasses an internal chamber for containing a fluid, at least one passage through said holding means providing communication between said chamber and the exterior of the holding means for said fluid and semi-sealing means co-operating with said holding means at least partially to seal said at least one passage on the holding means exterior in a manner such as to allow fluid from said chamber to pass along said at least one passage and escape therefrom via the semi-sealing means in a controlled manner.

Advantageously the semi-sealing means is a ring made of elastomeric material capable of absorbing said fluid.

Preferably the timepiece glass assembly includes fluid in said chamber.

Conveniently said fluid is a liquid scent, scented liquid or medicament containing liquid. Preferably, the chamber also contains movable objects or particles for decorative effects.

Preferably said semi-sealing means is replaceably removable to allow fluid and/or said movable objects or particles to be recharged in to the chamber through said at least one passage.

Advantageously the timepiece glass assembly includes an outer retaining ring-like means for releasably securing said glasses, holding means and semi-sealing means in a timepiece case in a manner such as to provide a gap to the case exterior in the vicinity of the semi-sealing means for escape of fluid from the chamber out of the assembly and case via the semi-sealing means.

Conveniently the holding means has an internal projection against which the peripheral regions of the glasses seat on opposite sides of the projection.

For a better understanding of the present invention, and to show how the same may be carried in to effect, reference will now be made, by way of example, to the accompanying drawings, in which:

FIG. 1 is a plan view from above of a timepiece, in the form of a wrist watch, incorporating a timepiece glass assembly according to the present invention, FIG. 2 is a view from one side edge of the timepiece and timepiece glass assembly of FIG. 1, and FIG. 3 is a cross-sectional view taken on the line A—A of FIG. 1.

A timepiece glass assembly of the invention is shown, by way of example, in the accompanying drawings in operative association with a wrist watch. However it is to be understood that the timepiece glass assembly of the invention can have any convenient form suitable for use with any particular type of timepiece such as a clock and is not exclusively restricted to a wrist watch form.

As shown in the accompanying drawings the exemplified timepiece glass assembly of the invention is generally reference as 1 and can be seen more particularly from FIG. 3 of the drawings. The assembly has a pair of superimposed, spaced apart, transparent glasses made up of an upper or outer glass 2 and a bottom or inner glass 3. In the illustrated example each glass 2 and 3 is circular in plan view but it is to be understood that the glasses 2 and 3 can have any convenient shape required by the particular design of timepiece with which they are to be used.

The assembly also includes means for holding the glasses 2 and 3 around their peripheries in the spaced apart disposition as shown in FIG. 3 to define between and with the glasses 2 and 3 an internal chamber 4 for containing a fluid. This fluid is preferably liquid and is more preferably a liquid scent or scented liquid or scent containing liquid. The fluid may or may not completely fill the chamber 4 and may or may not include or contain movable objects or particles 5 which are visible through the glasses 2 and 3 and which by their movement and/or particular form impart a decorative effect to the assembly.

The means for holding the glasses 2 and 3 around their peripheries in the spaced apart disposition is, in the illustrated example which employs circular glasses 2 and 3, an annular ring 6. This holding ring 6 is made of any suitable material such as plastics and/or metal and has an internal projection 7 therearound against which the peripheral regions of the glasses 2 and 3 seat on opposite sides of the projection 7.

At least one passage 8 and preferably more, although only one such passage 8 is shown for convenience in the illustrated embodiment, is provided through the holding ring 6 to provide communication between the chamber 4 and the exterior of the holding ring 6 for said fluid. To this end the or each passage 8 opens conveniently through the inner surface of the projection 7 at one end and through an outer surface of the holding ring 6 at the other end. Conveniently as illustrated the holding ring 6 has a groove formed therearound in the vicinity of the outer opening or the or each passage 8 to provide a seat 9 in which is located semi-sealing means in the form of a ring 10 of elastomeric material capable of absorbing the fluid.

The semi-sealing means ring 10 co-operates with the groove or seat 9 of the holding means ring 6 at least partially to seal the or each passage 8 on the holding means exterior in a manner such as to allow fluid from the chamber 4 to pass along the or each passage 8 and escape therefrom via the semi-sealing means ring 10 in a controlled manner. To this end the assembly also includes an outer retaining ring-like means 11 for releasably securing the glasses 2 and 3, holding means ring 6 and semi-sealing means ring 10 in a timepiece case such as the illustrated watch case 12. The outer retaining ring-like means 11 is releasably attachable to the watch case 12 in any convenient manner such as by means of screw threads 13 as illustrated. The outer retaining ring-like means 11 is internally shaped to provide an over hanging retaining shoulder 14 for engaging the holding ring 6 and/or the semi-sealing means ring 10 to hold the assembly in the watch case 12 with the inter position therebetween of a further sealing ring 15.

The outer retaining ring-like means 11 additionally in dimensioned such as to provide a gap 16 to the case exterior in the vicinity of the semi-sealing means 10 for escape of fluid from the chamber 4 out of the assembly 1 and case 12 via the semi-sealing means ring 10. The fluid is absorbed on the ring 10 and vaporises therefrom by the heat of the surrounding air and escapes through the gap 16 to the exterior of the assembly and watch case. If the fluid is scented this carries the scent to the outside of the watch which is particularly effective for use by a female user. Alternatively the fluid may carry an aftershave or cologne scent for use by a male user. If desired the fluid may also or alternatively carry a medical agent therein which is released to the exterior of the timepiece glass assembly 1 and watch case 12 via the gap 16 for medical purposes.

As illustrated in FIG. 3 the gap 16 which need not occur completely around the periphery of the holding ring 6, although it can do if desired, is formed by slightly reducing the interior diameter of the shoulder 14 at the upper edge thereof and/or slightly reducing the outer diameter of the holding ring 6 at the upper outer edge thereof. In this way the semi-sealing means ring 10 is allowed to communicate with the exterior of the assembly via the gap 16. As aforesaid the assembly 1 may be removed from the watch case 12 by unscrewing the outer retaining ring-like means 11 either for the purposes of recharging fluid to the chamber 4 via the at least one passage 8 or for complete replacement of the assembly 1 by another containing a different fluid and/or a different type of object or particle 5 for a different decorative, medical and/or scented effect.

In the example illustrated the assembly 1 of the invention is shown in conjunction with a watch case 12 which contains a conventional quartz watch movement 17 with minute, hour and second hands and a conventional hand setting stem 18 and button or crown 19. A watch dial plate 20 is also provided in the watch case 12 beneath the hands, which watch dial plate 20 carries the hour numerals and minute numerals if desired. The hands and numerals on the watch dial plate 20 are thus visable through the assembly 1 via the glasses 2 and 3 and the fluid containing chamber 4. The fluid if it contains movable articles or particles thus provides to a viewer a decorative effect overlaying the watch hands and dial plate 20. Additionally in the example illustrated the timepiece assembly 1 which is shown in conjunction with a wrist watch case 12 by way of example, is also shown in conjunction with a strap 21 of any convenient form for the wrist watch case 12.

I claim:

1. A timepiece glass assembly having a pair of superimposed, spaced apart, transparent glasses, means for holding said glasses around their peripheries in said spaced apart disposition to define between and with said glasses an internal chamber for containing a fluid, at least one passage through said holding means providing communication between said chamber and the exterior of the holding means for said fluid and semi-sealing means co-operating with said holding means at least partially to seal said at least one passage on the holding means exterior in a manner such as to allow fluid from said chamber to pass along said at least one passage and escape therefrom via the semi-sealing means in a controlled manner.

2. An assembly according to claim 1, wherein the semi-sealing means is a ring made of elastomeric material capable of absorbing said fluid.

3. An assembly according to claim 1, wherein said semi-sealing means is replaceably removable to allow fluid and/or movable objects or particles to be recharged in to the chamber through said at least one passage.

4. An assembly according to claim 1, including an outer retaining ring-like means for releasably securing said glasses, holding means and semi-sealing means in a timepiece case in a manner such as to provide a gap to the case exterior in the vicinity of the semi-sealing means for escape of fluid from the chamber out of the assembly and case via the semi-sealing means.

5. An assembly according to claim 1, wherein the holding means has an internal projection against which the peripheral regions of the glasses seat on opposite sides of the projection.

6. An assembly according to claim 1, including fluid in said chamber.

7. An assembly according to claim 6, wherein said fluid is a liquid scent, scented liquid or medicament containing liquid.

8. An assembly according to claim 1, including movable objects or particles in said chamber.

9. A timepiece provided with a timepiece glass assembly as claimed in claim 1.

* * * * *